United States Patent [19]

Bolt

[11] Patent Number: 5,046,514

[45] Date of Patent: Sep. 10, 1991

[54] SMOKING MATERIAL AND PROCESS FOR MAKING SAME

[75] Inventor: Anthony J. N. Bolt, Henbury, England

[73] Assignee: Imperial Tobacco Limited, Bristol, England

[21] Appl. No.: 171,833

[22] Filed: Mar. 22, 1988

[30] Foreign Application Priority Data

Mar. 23, 1987 [GB] United Kingdom ..... 8706812
Dec. 23, 1987 [GB] United Kingdom ..... 8730066

[51] Int. Cl.[5] ..... A24B 15/16; A24D 1/18
[52] U.S. Cl. ..... 131/359; 131/369
[58] Field of Search ..... 131/359, 369

[56] References Cited

U.S. PATENT DOCUMENTS

| | | | |
|---|---|---|---|
| 2,576,021 | 11/1951 | Koree | 131/359 |
| 2,809,904 | 10/1957 | Koree | 131/359 |
| 3,118,452 | 1/1964 | Moshy | 131/359 |
| 3,478,751 | 11/1969 | Briskin et al. | 131/359 |
| 3,638,660 | 2/1972 | Davis | 131/369 |
| 3,931,824 | 1/1976 | Miano et al. | 131/359 |
| 3,934,594 | 1/1976 | Beringes et al. | 131/359 |
| 4,296,762 | 10/1981 | Eicher et al. | 131/359 |

*Primary Examiner*—V. Millin
*Attorney, Agent, or Firm*—Larson & Taylor

[57] ABSTRACT

A smoking material consists of an open-structured cellulosic substrate having a crystallizable or semi-crystallizable coating that includes a sugar such as lactose or glucose or a mixture of lactose and glucose. The coating may be in the range of 50–95% of the weight of the smoking material, and the sugar may be 20–90% by weight of the coating.

36 Claims, No Drawings

SMOKING MATERIAL AND PROCESS FOR MAKING SAME

This invention concerns a novel smoking material for use in cigarettes, cigarillos, cigars, pipes and other smoking articles, and relates in particular to a smoking material comprising a coated substrate, to a process for manufacturing such a material, and to a smoking article including the smoking material.

The smoking material of the present invention constitutes an improvement over materials of the prior art particularly with regard to processability, burning character, nicotine stability, smoke flavour acceptability and cost, and is superior to tobacco especially with regard to the scope the smoking material affords for altering smoke flavour and aroma properties.

Numerous attempts have been made to develop smoking materials which could replace, wholly or in part, the tobacco in cigarettes and other smoking articles. The prior art has been reviewed in "Tobacco Substitutes" by M. Sitting, Noyes Data Corp., 1976 and in British Patent 2028096B (Philip Morris).

Among the many alternative smoking materials which have been proposed in the reviewed prior art, frequent reference has been made to the use of cellulose, cellulose-rich or cellulose-like materials. Such materials are readily available but are known to generate an unacceptable acrid "burning paper" smoke character and considerable efforts have been made to overcome this problem. It has been claimed that oxidation and/or thermal degradation of cellulose in the presence of catalysts reduces tar delivery and gives a smoother, less irritating and sweeter smoke. However, attempts to improve the smoking quality of cellulose and cellulose-like materials in this manner have not been wholly successful. In addition, extensive cellulose degradation significantly decreases its mechanical strength and results in the formation of unsatisfactory large amounts of dust during processing and manufacturing.

A solution to the above problem has been found by forming sheet material in a casting process from slurries of oxidized or thermally degraded cellulose to which binding or film-forming agents such as soluble cellulose esters or ethers, carboxymethyl cellulose and its sodium salt of natural polyuronic acids have been added.

However, the presence of binding agents often leads to an impairment of smoke taste particularly when significantly high concentrations are necessary to impart adequate strength to the resulting sheet materials.

Several smoking materials of the prior art include relatively large proportions of inert fillers and other ash-forming agents. These serve to reduce tar-forming potential and also to promote combustion by imparting a more open texture to the material thereby facilitating access of oxygen.

However, over-use of inert fillers and other inorganic materials is known to cause self-extinguishing, impaired ash cohesion and dropped coals in cigarettes. High levels of inorganic fillers can also have an adverse effect on smoke taste either by causing atypical muffled burning or as a result of excessive mechanical entrainment of these materials into mainstream smoke.

Metal carbonates, particularly those of calcium and magnesium have frequently been selected from a wide range of inorganic substances known to the art. These compounds are said to be beneficial in that they promote more complete combustion but they are alkaline by nature and sufficiently soluble to cause the pH of materials in which they are incorporated to rise above pH 7. The alkaline smoking materials thus formed not only were incapable of holding a constant level of nicotine owing to its loss by volatilization and decomposition but they also tended to destabilise endogenous nicotine in tobacco with which it was necessary to blend them (cf. British Patent 1502132) in order to overcome the disadvantages mentioned above.

Relatively high bulk density and concomitant low filling power compared with tobacco has also been a feature of prior art smoking materials. Whereas partial solutions have been attained by casting foamed slurries or by causing foaming to occur during drying, physical strength and processability have thereby been compromised. Addition of binders to increase the strength of the foamed structure is likely to impair taste.

The unpleasant organoleptic character of cellulose smoke is a deterrent to large scale uses of cellulose in smoking materials. The chemical structure of cellulose is essentially a chain of glucose units linked via the C1 and C4 carbon atoms. It is perhaps therefore somewhat surprising that the volatile compounds which are generated by cellulose pyrolysis do not bear close quantitative resemblance to the compounds similarly generated by pyrolysis of glucose itself. Cellulose pyrolysates are typified by the presence of anhydrosugars. Relatively high amounts of trihydroxybenzenes and other phenolic compounds are also present and it is there which are thought to contribute significantly to the "burning paper" character of cellulose smoke. Aldehydes are also prevalent and succinaldehyde in particular has been implicated in its pungent and irritating odour.

A typical tobacco blend may contain no more than 10% by weight of cellulose but if other cellulose-like compounds such as hemicelluloses and pectic substances are included, then approximately one third of tobacco weight is accounted for. "Burning paper" character is discernable by trained observers in conventional tobacco cigarettes but is is appreciably masked by smoke components generated from other leaf constituents particularly sugar, proteins, amino acids, amino acid/sugar complexes, lipids resins and the volatile oils.

In contrast to the position in cellulose, the product of glucose pyrolysis exhibits burnt-sugar, caramel-like character which is significantly more acceptable to the smoker. This feature is perceivable in smoke generated from flue-cured tobacco and from air-cured varieties which have been treated with sugar-containing materials and it makes an important positive contribution to smoke quality. In addition to glucose, fructose also contributes to tobacco smoke sweetness and there are other monosaccharides such as xylose, disaccharides such as sucrose and possibly short-chain oligosaccharides which also have a role in this respect.

The smoke condensates of simple sugars like glucose, galactose and lactose, in common with cellulose, all contain anhydrosugars and phenolic compounds. Minor components with sweet odour character like cyclotene, maltol and cyclopentan-1,2-dione also have a role in the smoke aromas of simple sugars but these are also present in cellulose smoke at similar concentrations. The main difference compared with cellulose smoke appears to be the relatively greater amounts in sugar smokes of dimethyl-4-hydroxy-2H-furan-3-one and 2,3-dihydro-3,5-dihydroxy-6-methyl-4H-pyran-4-one. The former compound has an intense sweet odour while the latter, although odourless, is known to degrade readily to isomaltol which also has a sweet odour. These compounds are accompanied in sugar pyrolysates by the powerfully sweet compound acetoformoin which we believe to be a significant contributor to the perceived sweet aroma.

These sweetly aromatic compounds are formed in sufficient quantities to overcome the undesirable effects of the phenols and aldehydes which are also formed in sugar pyrolysis but which, in contrast, are free in cellulose smoke to exert their influence. Assuming that an excess of sweetness is available in sugar pyrolysates, we would conclude that a distinct improvement in the smoke taste of carbohydrate-based smoking materials could be obtained by reducing the proportions of cellulose and related polymeric substances in favour of simple sugars.

Although the use of mono- and disaccharide sugars in smoking material is known, concentration levels have necessarily been restricted by the tendency of these highly water soluble and hygroscopic compounds to cause unwanted stickiness or tackiness in the materials in which they are incorporated. The sugars of flue-cured tobacco for example are collectively hygroscopic and in isolation they form a sticky gum. This is characterised by a prevalence of hydroxyl groups not involved in crystal-forming intermolecular hydrogen bond formation and therefore available for hydrogen bonding with ambient moisture. Such stickiness is not normally manifest in flue-cured tobacco leaf material even at high relative humidity because the sugars are extensively contained by fibrous cell wall materials. When high sugar flue-cured tobaccos are reconstituted, these sugars are withdrawn from the protective cell wall fibres and extensively laid down on external surfaces thereby giving rise to a potential stickiness problem. The sugary mixtures used to case air-cured tobaccos are also sticky by nature but this is counterbalanced by the excellent absorptive properties of such tobaccos.

U.S. Pat. No. 3112754 (Diaz) describes the use of caramelized sucrose in a suspension of inorganic and flavourful organic materials which is deposited on fibrous material such as tobacco leaves or rice paper. In U.S. Pat. No. 3112754 calcium carbonate is recommended for use as a carrier and, in view of its low solubility in water, it may help to reduce the stickiness that the sugar-containing deposite may otherwise cause.

U.S. Pat. No. 2576021 (Koree) advocates the inclusion of simple sugars such as glucose, sucrose and lactose in aqueous compositions for application to a web of baggage fibres. The fibrous bagasse however is present in Koree's product in an amount greater than the weight of the combined components of the applied compositions thereby minimising the stickiness which higher relative levels of the sugar-containing compositions may engender.

According to a first aspect of the present invention there is provided a smoking material consisting of an open-structured substrate of cellulosic material having a crystallizable or semi-crystallizable coating including at least one sugar.

For the purposes of the present invention "sugar" will be understood to include mono- and di-saccharides, short chain oligo-saccharides, monosaccharides anhydrosugars, glycosides, and derivatives thereof.

According to a second aspect of the present invention there is provided a process for making a smoking material comprising treating an open-structured cellulosic web with a crystallizable or semi-crystallizable preparation containing at least one sugar, drying the treated web, and subsequently storing the dried treated web until a spontaneous curing process which involves crystallization or semi-crystallization is substantially complete.

According to a third aspect of the present invention there is provided a smoking article including the smoking material of the first aspect.

We have found that by careful choice of sugars, by careful selection of relative proportions where more than one type is used and with due regard to the relative concentrations of other components, that useful smoking materials may be manufactured in which surprisingly high proportions of certain sugars may be incorporated. Indeed the proportions of simple sugars contained in the smoking materials of this invention are up to an order of magnitude higher than those contemplated in the prior art.

Although the invention is not restricted by present theoretical understanding, it is our belief that the unexpectedly good physical properties exhibited by the sugar-rich smoking materials of the present invention are accounted for by the ability of the sugar content to crystallize after it has been applied to the substrate. The proportion of the cellulosic substrate is correspondingly low and in effect the role of the cellulose is substantially confined to that of imparting physical strength. This is of benefit to the organoleptic properties of the smokes generated from these materials.

In the preferred embodiment of the invention aqueous solutions, emulsions or suspensions are prepared in which the main constituents are selected sugars, other smoke-forming agents, ash improvement agents and burn control agents. Nicotine or its derivatives, colouring agents and aroma/flavour agents are optional additives along with other smoke modifying agents. Such preparations are applied by coating, spraying or immersion to a highly porous open-structured cellulosic web. This is then dried, cut and cured prior to manufacturing into smoking articles.

We have observed that when the water in films of aqueous sugar solutions is allowed to evaporate, crystallization or semi-crystallization of the contained sugar may occur, depending on the nature of the sugar, and, where more than one sugar is mixed, on the relative proportions of each component. For films which do crystallize the intervals before onset and completion of crystallization also depend on the nature of the sugar and the relative proportions of sugars in mixed systems.

Concentration, ambient temperature and humidity are also factors which have a role in this respect as does the nature and concentration of other components included in the aqueous sugar systems.

Large numbers of monosaccharide sugars are known, the main group being the D family of aldoses which are all related to D(+)-glyceraldehyde. However, only a few of these are readily available and relatively inexpensive. As well as aldoses, ketoses, monosaccharide anhydrosugars, glycosides and other derivatives are also candidates for inclusion in smoking materials of this invention. Of all these substances, that which best satisfies the criteria of crystallisability, availability, cost and smoke aroma/flavour at the present time is glucose. Galactose and xylose readily pass the crystallisability and flavour tests but they do not match glucose in availability and price.

Naturally occurring and readily available disaccharides and their derivatives are far fewer in number and at the present time, within this group, only lactose satisfies criteria of availability, cost and crystallisability. The smoke aroma/flavour of lactose is mild an pleasant although it appears to be less sweet compared with that of glucose.

The dissacharide sucrose and the monosaccharide fructose are both readily available and inexpensive and both exhibit good subjective smoke character. However, they do not crystallise rapidly from drying aqueous films and we have found therefore that the use of these two sugars in sugar combinations is best restricted to minor levels where they both have a role as smoke-sweetening agents. While it will be appreciated that many combinations of sugars are possible within the scope of this invention, we have found that the criteria we have invoked are best satisfied by either glucose alone or lactose alone or a combination of glucose and lactose in which the proportion of glucose is between 20 and 40% by weight.

It will be appreciated in view of the foregoing description that the main constituents of the smokable materials of the present invention are simple sugars. The concentration of sugars may be as high as 80% by weight of the finished material weight although the preferred range is 20–70%.

We have found quite surprisingly that incorporating large quantities of crystallisable sugars in our formulations in turn enables relatively large quantities of compounds to be added which are normally liquids at ambient temperatures and which are subsequently distilled substantially unchanged into smoke. Thus polyhydric humectants/plasticisers such as glycerol, glycerol monoesters and propylene glycol may be added at concentrations which are much higher than those normally associated with smoking products without causing undue stickiness, loss of filling power, loss of physical strength or associated problems. Total concentrations of humectants/plasticisers may be as high as 30% of the finished material weight although the preferred range is 4–20%. Likewise, polyhydric alcohols such as sorbitol which are normally solids at ambient temeperatures but which have sufficiently high vapour pressures to be distilled largely unchanged into smoke, may also be incorporated.

Lipoidal and lipophilic compounds are also useful additives in this respect. Hydrocarbons, fatty acids, fatty alcohols and fatty esters such as palmatic acid, dodecanol and methyl palmitate, di- and triglycerides such as dipalmitin and triolein are examples of compounds which may be added singly or in combination. Natural lipid mixtures such as olive oil, corn oil, arachis oil, coconut oil, palm oil, linseed oil, jojoba or cocoa butter may also be utilised.

The components of smoke generated from smoking materials are considered to be formed predominantly either by combustion or by direct distillation of volatile components or by distillation of the volatile degradation compounds formed from non-volatile components by pyrolysis and pyrosynthesis. It is a distinct advantage in smoking materials of the present invention that, if required, considerably greater emphasis may be placed on the direct distillation mechanism in the smoke-forming process.

Smoking materials of this invention contain conventional ash improvement agents and burn control agents. We have found that, of the large number of materials known to the prior art, the calcium and potassium salts of organic polycaboxylic and hydroxy acids such as oxalic, tartaric, citric, malic and lactic acids, are particularly useful components in this respect. Their major role is that of acceptable ash formation since the open structural nature of the materials of this invention affords good inherent combustibility without the need for critical selection of burn modifying agents.

It has been found that the burning and smouldering character of the material of the present invention is comparable to that of tobacco when smoked under analogous conditions and it is believed that such characteristics are controlled to a large extent by the nature and concentration of organic constitutents in the web and the physical nature and juxtaposition of shreds of the material in cigarettes or other smoking articles.

Potassium salts are soluble in water and are readily incorporated into the concentrated aqueous solutions with which the cellulosic webs are treated. On the other hand, the appropriate calcium salts are essentially insoluble in water. They may be added in the form of aqueous suspensions of finely powdered material.

Alternatively and preferably, the calcium salts are formed in situ in the aqueous mixtures by mixing soluble calcium salts such as the acetate or formate with aqueous solutions of the aforementioned acids or by adding to the latter, calcium carbonate or calcium hydroxide. A period of time elapses after mixing before precipitation of the corresponding calcium salts occurs. This phenomenon is known to the prior art (cf. U.S. Pat. No. 3638660 assigned to Howard J. Davis and U.S. Pat. No. 3720660 assigned to Gallaher) and is attributed to the relatively slow rate at which water of crystallisation is stoichiometrically acquired in the crystal lattices.

The addition of inert fillers, binders/film forming agents and cross-linking, physical strength and wet/-strengthening agents is not normally required, but any such substance known to the prior art may be applied when particular effects are sought. It is a feature of the present invention that total homogeneity of the smokable material is achievable by presenting all additives to the cellulosic web in a solubilised form. However, it is also within the scope of the invention to use particulate additives and thereby to present to the web a heterogeneous mixture. When this option is adopted, efficient mixing is essential to ensure homogeneous deposition of the additive mixture in the resulting smoking material.

The smoking material of the present invention is designed to be universal in its application. Hence it may be used as an extended in a tobacco blend or as a replacement for a component of the blend, for example as a replacement for the flue-cured tobacco component or the casing material in Continental or American-type blends. Alternatively it may be used as a smoke modifier, for example when a particular flavour effect is sought. In these cases, the inclusion of nicotine may or may not be required. The maximum potential of the smoking maerial is realised when it is intended to be used as a complete smoking material and in this case inclusion of nicotine may be desirable.

Nicotine is incorporated in the material by adding natural nicotine or any nicotine derivative or natural extract known to the art to the additive mixture prior to application to the cellulosic web. However, it is preferable that concentrated forms of nicotine are initially converted to dilute, preferably solid forms. This is achieved by mixing nicotine or its derivatives in water with other water-miscible additives of the invention and spray-drying or spray bed drying the resulting solution or emulsion preferably at pH 5 or lower; to give a free-flowing fine or agglomerated powder.

Spray-dried powder prepared from a single batch of a stirred aqueous solution or stable emulsion is essentially homogeneous. Therefore any one sample taken from a batch of spray-dried powder for quality control purposes should be representative of the entire batch. Nicotine concentration is readily checked in this way. The spray-dried powder is reconverted to a concentrated aqueous solution or emulsion and applied to the cellulosic web.

Adoption of this preferred embodiment results in a product having a consistent highly controllable level of nicotine. The concentration of nicotine or its derivatives may be selected as required to suit particular products but would normally reside within the range 0.5 to 10% by weight. Preferably concentrations would be within 1-5% or even more preferably within the range 2-3.5%.

Very important aspects of non-tobacco smoking materials are the aroma and flavour properties of their smokes, for it is mainly shortcomings in this area which have been detrimental to the success of the prior art materials. The background aroma and flavour notes in the smoke from an essentially carbohydrate-based smoking material are those which are generally associated with either burning paper or burning sugar. The far greater emphasis deliberately placed on the use of simple sugars in the smoking materials of the present invention allows the considerably more acceptable sweet burnt sugar character to predominate. The types of aroma and flavour additives which are appropriate for these materials are limited only by the requirement to complement or blend appropriately with this sweet background character.

Traditional tobacco aroma and smoke flavour character may be developed by including tobacco extracts, distillates, resinoids or oils. Flavour and aroma character of a type which is associated with tobacco products may be developed by adding flavour and aroma components well known in the tobacco flavourist's art. For example, vanillin, coumarin, menthol, essential oils such as flouve and foin, resinoids, plant and fruit extracts such as licorice, prune, raisin and apple extracts may be used. Discrete chemical compounds such as esters, lactones and ketones or mixtures thereof may also be used. Compounds which are known in the art to be precursors of aroma and smoke flavour in tobacco or other natural products such as amino acids or Maillard reaction products may, if required, also be added.

Again, unusual or untraditional aroma and flavour may be introduced with highly aromatic materials such as the oils of ginger, cinnamon, clove and eucalyptus. Alternatively, more subtle aromas such as those of cedarwood, sandalwood and tea may be chosen. Chemically synthesized aroma/flavour precursors such as vanillin glucoside, vanillin-urea complexes and aliphatic acid esters of glucose may be introduced or the materials may be provided with encapsulated or physically entrapped aroma flavour compounds. A vast array of flavouring and fragrance materials, nature-identical, natural and synthetic, is available and this offers considerable scope to impart subtle and attractive flavour and fragrance properties particularly since the smoking materials of this invention are designed not to display overstrong intrinsic background smoke aroma and flavour character. A wide range of consumer preferences may thus be catered for.

Where nitrogen-containing compounds are required to be added to produce a particular flavour effect, preference is given to volatile compounds such as certain pyrazines, pyridines and pyrroles and even more preferably these compounds are incorporated in the filter tip of cigarettes rather than in the combustible section.

The visual appearance of all embodiments of this invention may be enhanced by the addition of one or more colouring materials. A wide range of such materials is available which are either natural, nature-identical or of synthetic origin but choice will be limited in most countries which regulate and control the additives which may be used in smoking products. The familiar brown, orange and yellow colours of natural tobacco are readily attainable using natural or nature-identical colours such as caramel and the carotenoids $\beta$-carotene and annato (otherwise known as "bixin") and the carotenoids may be stabilised by the addition of antioxidants, particularly natural endogenous antioxidants and radical scavengers such as tocopherols, ascorbic acid, retinol, and esters of these. Alternatively, or in conjunction with these, synthetic food colours such as sunset yellow may, where approved, be used.

Smoking materials of the present invention, particularly those embodiments in which relatively high levels of polyhydric alcohols or other innocuous distillable compounds are incorporated, by design and in practice yield smokes which have lower levels of those combustion products typical of conventional tobaccos. This is mainly because as explained above, these innocuous compounds are distilled substantially unchanged into mainstream smoke thereby reducing other substances by dilution. Further, when glycols are present, reaction occurs between these and aldehydic compounds generated in the burning process thereby contributing to mildness in the smoke.

With regard to conventional tobacco smoking materials, much time and effort is expended in converting mature leaves of tobacco plants into a material suitable for manufacturing into smoking articles. Numerous processes such as curing, aging, threshing, stem treatment, blending and shredding are involved. Some of these processes require moisture adjustment both upwards and downwards and the total process adds significantly to the cost of the tobacco smoking material.

Energy cost disadvantages are also attendant on the production of reconstituted tobacco and substitute smoking materials by the cast sheet method in that the water content of slurries from which the materials are made normally needs to be relatively high (e.g. 80-90%) in order to deposit a film evenly on the drying band. The extensive drying which is therefore necessary significantly increases the energy cost.

The water content of mixtures from which smoking materials are made by roll mill extrusion and by extrusion of filaments is much lower (e.g. 30-40%) but the pressure required to extrude these materials normally results in unsatisfactory dense products. These processes also exert considerable constraints over composition of the mixtures.

The paper making-type process is an improvement on the cast sheet process with regard to energy costs but again the composition of materials that can be manufactured by this process is necessarily dictated more by physical considerations than by the requirements of subjective acceptability. In the materials of this invention, all these problems of the prior art are eliminated or at least substantially reduced.

The combustible prefabricated base materials of the smoking materials according to this invention are preferably fibrous webs or fleeces prepared from natural, regenerated, synthetic or chemically modified carbohydrate substances and having a weight per unit area of 5–150 g/m$^2$. and a thickness within the range 5 to 150 microns. Alternatively, they may be discrete cellulosic (e.g. cotton) threads or assemblies thereof. Paper-like webs prepared from wood pulp or abaca cellulose by conventional wet processes are particularly suitable. Such materials may, if required, be pre-treated with modifying agents such as burn-promoting or burn-retarding agents or wet-strengthening agents. It has proved particularly advantageous to produce products according to the invention in which the base material is in the form of highly porous paper-like webs having a weight per unit area of 10–30 g/m$^2$ and a thickness of 10–30 microns.

Porous webs used commercially for the manufacture of teabags are suitable. Of these, materials designed to be used for unsealed teabags and which are wet-strengthened with regenerated cellulose (e.g. viscose) are preferred. Those designed to be used for heat-sealable teabags are normally treated with polyamide/epichlorohydrin resin for wet-strengthening and heat-sealing purposes and are less preferred. Where the inherent strength imparted by the frictional forces between the fibres of the web needs to be augmented, any cross-linking, physical strength or wet-strengthening agent known to the art may be applied but careful consideration is given to the implications for subjective properties of the smokes generated therefrom. Fibrous webs developed for use as plugwraps in the tobacco industry normally having a porosity within the range of 50–1000K are also suitable (K is measured in ml/min./10 cm$^2$ surface area/10 cm. water gauge applied pressure). Those having a porosity in the range 650–1000K are preferred. Even higher porosities may also be contemplated as long as wet-strength of the web and physical strength of the strands of the finished smoking material are not seriously compromised.

The non-fibrous components of the smoking materials of this invention are applied to the porous web base material in the form of a solution, emulsion or suspension by immersion, spraying, coating on a band or roller or coating by passing between two or more rollers. The process liquid is preferably water but other protic solvents may be substituted or mixed with water to obtain the required solvent and evaporative properties. The calcium (and other Group II metals) salts formed with acids such as citric, malic and tartaric acids are only very sparingly soluble in water and pre-formed salts are therefore applied to the web in the form of a suspension.

Preferably however, as mentioned earlier, the required calcium salts are formed in situ by mixing either soluble forms of calcium such as the acetate, or the hydroxide or carbonate, with the appropriate acids shortly before application to the web. Solutions, emulsions or suspensions may be applied to the fibrous web at temperatures which range from ambient to their boiling points. All components may be added in one batch or they may be segregated into two or more batches which are applied separately.

It has proved to be particularly advantageous to apply the volatile aroma/flavour materials to the web in a separate operation prior to the addition of the other components. This is achieved by immersion, spraying or coating using neat mixtures or solutions or emulsions of the aroma/flavour material preferably in low-boiling protic or aprotic single or mixed solvents. Water may also be used, in which case azeotropic mixtures with other protic solvents are preferred. The web may be thus treated as it is drawn from the roll or the entire roll may be immersed in the aroma/flavour preparation.

The required concentrations of volatile aroma/flavour in the web material is essentially controlled by adjusting concentrations of the solutions or by adjusting spray or coating rates where these techniques are used or by a combination of these. Process solvents, where they are used, are preferably evaporated from the web prior to further treatment. The advantage of applying the volatile aroma/flavour components before addition of the other components of the smoking materials is that good fixation and stabilisation results. The volatiles sorbed onto or into the fibrous structures are effectively encapsulated by succeeding layers of components deposited upon them.

Lipoidal or non-polar components may also be applied separately, preferably following the addition of the polar substances. It has been found to be particularly effective to apply carotenoid colourants in this way. Careful control of fatty acid concentration can result in monolayer formation owing to the affinity between the carboxyl groups of the acids and the hydroxyl groups of the underlying polar constituents thereby helping to ensure even coating. Separate application of non-polar compounds in this way further aids the fixation of volatile aroma/flavour compounds applied initially to the web. It also reduces the hygroscopicity of the finished material and improves its slipping properties in cigarette making machinery. Alternatively, application of non-polar components may be made after the material is cut into shreds. In this way the newly cut edges are also coated.

Aqueous mixtures of the polar additives are preferably highly concentrated so that the desired dry weight concentration can be applied to the web in one pass and with the added advantage that relatively low concentrations of water or its azeotropes are required to be removed. Preferred loadings of additives relative to the web weight of between 4:1 and 9:1 are achievable in one pass.

Following application of components to the web, residual water or other process solvents may be removed by drying at ambient temperatures or by passing through a drying system. Drying at ambient temperatures requires that suitable lengths of the semi-finished article are kept apart, preferably in a vertical racking system until curing (i.e. crystallisation or semi-crystallisation) is complete or at least until it is sufficiently advanced that the sheet surfaces do not adhere on contact.

Moisture removal may be expedited using a dehumidifier system but maintenance of moisture content at very low levels is avoided since under these conditions curing is inhibited.

When forced drying is pursued it is possible subsequently to bulk the dried material for storage or for further handling. Moisture is reduced below the level at which adhesion can occur and the material may then be stored in sheet form, in smaller pieces or in shredded form prior to further handling operations. During this period the moisture content is maintained at levels which promote effective curing but inhibit intersurface adhesion. Unlike tobacco leaf these materials are strong and flexible even at low moisture contents.

Where blending the materials of this invention with tobacco leaf material at the pre-shredding stage is not intended, we have found that a particular advantage is to be gained by shredding the dried sheet material soon after manufacture and storing the shreds in bulk for at least one day. In this way the shreds come to rest in random and irregular formations and such formations are perpetuated by the subsequent crystallisation of the contained sugars whereupon moisture may be raised to levels suitable for cigarette manufacture. Smoking material thus formed closely resembles conventional tobacco shreds in physical form and this not only expedites its manufacture into cigarettes using conventional cigarette-making machinery but also is a beneficial feature with regard to ash cohesion.

The dried or semi-dried coated web may be fluted or twisted and maintained in random conformation to cure in a loose or compressed bale. Following curing, the material may be sliced and diced prior to shredding in the normal way.

Alternatively, it may be subjected to a type of threshing process thereby reducing it to pieces of irregular shape and size. This process is expedited by reducing moisture to a low level. Material which has been treated thus, on shredding, assumes "curl", that is, a curled configuration which closely resembles that of shreds of the natural cured leaf. Addition of browning colour in an irregular fashion may be achieved by spraying unevenly the wet or semi-dried coated web or by streaking the colour in at the coating stage. Uniform, random or patterned browning may also be achieved by contacting the coated web with hot surfaces. A combination of graduated brown colouring followed by overcoating with the yellow carotenoid $\beta$-carotene and the aforementioned "curl" results in a material which, in appearance and manufacturing behaviour, is remarkably similar to natural leaf tobacco.

Alternatively or in addition the semi-finished web material may be texturised by crimping, crepe-texturing or embossing by means well known in the art. The drying and texturising process may be combined by passing the incompletely dried web through a roller system such that protuberances on the rollers cause deformation in the web. Further drying at the roller site to less than 10% moisture results in maintenance of the deformation which, following shredding, is further accentuated by storing the shreds in bulk. Strength of the individual shreds is greatest when their longitudinal axes are parallel to the web making machine direction and least when it is at right angles thereto.

Prior to curing, further drying of the shreds may be achieved by introducing them to a turbulence chamber where heated air jets impart to the particles a whirling motion to dry them. Subsequently, they are conducted pneumatically to storage containers. A winnowing process may also be interposed thereby separating "fines" from the shreds before their entry to cigarette making machines. The fines may be redissolved or resuspended and recycled. It will be evident to those well versed in the art of tobacco manufacture that many of the devices available to conventional tobacco processing are applicable to the smoking materials of this invention.

The materials of this invention are universally applicable to all types of smoking product. They are particularly suitable for use as blend components and as complete filler materials for "roll-your-own" and manufactured cigarettes. Cigarettes may be of any conventional design but the material, being novel, lends itself particularly to novel cigarette designs. Short, slow-burning cigarettes which give normal yields and puff numbers but which contain less fuel and generate less sidestream are particularly favoured. The overall length of such a product can be maintained by using longer than normal conventional tips or tips of the papirossi kind.

It is known in the art to design cigarettes containing tobacco in which the tar/nicotine ratio is much reduced compared with that of more conventional products, the aim being to reduce the quantity of tar that the smoker must ingest in order to acquire his or her normal requirement in nicotine. This is achieved by using tobaccos which have higher than normal nicotine concentrations.

However, problems occur which militate against the complete success of this approach.

Firstly, leaf tobacco which is high in nicotine also tends to be high in tar potential and is generally more expensive to produce than counterparts containing a lower level of nicotine.

Secondly, high nicotine tobacco tends to contain greater than normal levels of protein and other nitrogenous compounds. The effect of this is to render both the mainstream and the sidestream smoke subjectively less acceptable. These problems do not arise in the materials of this invention.

A particularly important feature of the invention is the ability to control smoke pH by adjusting the components and to control nicotine concentrations. This allows cigarettes which combine surprisingly low tar to nicotine ratios with good subjective acceptability to be produced.

Good scope is offered for the design of filter tips for cigarettes which incorporate smoking materials of the present invention. The role of filter additives such as activated carbon or carbon monoxide reduction agents for example is enhanced compared with performance in conventional cigarettes. This is because deactivation of such additives by certain tobacco smoke components, particularly those containing sulphur, is considerably reduced in the preferred embodiments.

Scope also exists to manufacture cigarettes by means which may be more cost-effective than are the conventional procedures. Thus cigarettes may be made by a modified filter-making process in which a thin web or fleece of finished or semi-finished material prepared according to this invention is drawn through a garniture and wrapped in paper in a manner similar to that in which filter rods are produced. This process is particularly effective when it is conducted on line with the smoking material fabrication process.

Drying and/or curing may be conducted before the rod is formed, or drying may be effected after rod formation but preferably before the rod is wrapped. Alternatively, the web or fleece may be formed into a continuous loose rod in the normal way prior to immersion into a solution, emulsion or suspension of the non-fibrous components using pressure if necessary to ensure penetration to all parts. Any unwanted excess of additives is removed, preferably under reduced pressure, and the coated rod is then dried, wrapped in the normal way and cut into suitable lengths to cure prior to cigarette manufacture.

The material of this invention may also be used as a binder or wrapper for cigars, cheroots and the like. When use as a wrapper is envisaged it is particularly advantageous to apply the non-polar components to the semi-finished product either by spraying or by complete or partial immersion in a solution of the said non-polar components. Alternatively the material may be treated to simulate natural tobacco leaf before the web is cut, as is known in the art.

Useful smoking materials may also be formed using the sugar-containing mixtures of this invention in which tobacco stem and/or other fibrous material is laid down as a web, as in the reconstituted tobacco paper-making process, and treated with liquors. In this instance the liquors include the sugar containing mixtures of this invention which subsequently crystallise or semi-crystallise to give a highly processable material in which the adverse smoke taste character attributable to the high fibrous content is extensively ameliorated. Further, the crystallisable sugar-containing mixtures of this invention are also useful additives with respect to conventional tobacco smoking materials both unreconstituted and reconstituted; they may be added to the tobacco material by spray coating or immersion and act primarily to ameliorate smoke taste and improve filling power.

The invention will now be described by way of example only with reference to the following non-limiting examples. In the examples all composition percentages and ratios are to be taken as being with reference to weight unless otherwise stated.

EXAMPLE 1

Glucose (240 g), lactose (560 g), citric acid (135 g), potassium citrate (100 g), glycerol (100 g) and nicotine (35 g) were stirred with water (1050 ml) at 60° C. until dissolution was complete. The solution (pH 5) was cooled to 30° C. and stirring was continued with the gradual addition of calcium carbonate (60 g).

Following cessation of effervescence, 150 cm. lengths of 25 cm. wide Dexter G10 web supplied by C. H. Dexter Limiter of Chirnside, Duns, Berwickshire, Scotland, TD11 3JU, were drawn through the clear solution. The lengths of coated web were suspended in a rack. Precipitation of calcium citrate in the residual solution reached and advanced state approximately 30 minutes after completion of the solution preparation, whereupon no further web coating was undertaken. Crystallisation of the components in the air-dried coated webs, stored at ambient relative humidity, was substantially complete within 24 hours. The smoking material was then cut and shredded at 12.8 cuts per cm and stored in bulk for 2 weeks to complete the curing process. The approximate proportions of components in the smoking material at 11.0% moisture are shown in Tables 1 and 2.

TABLE 1

| | % |
|---|---|
| cellulose web | 15.9 |
| glucose | 14.8 |
| lactose | 34.6 |
| glycerol | 6.2 |
| calcium citrate and nicotine citrate | 11.3 |
| potassium citrate | 6.2 |
| water | 11.0 |

TABLE 2

| | % |
|---|---|
| calcium ion | 1.5 |
| nicotine | 2.2 |
| potassium ion | 2.3 |

EXAMPLE 2

Dexter G10 web was drawn through a bath containing a solution of vanillin (1.2 g) in ethanol (300 ml) and residual ethanol was evaporated. Glucose (220 g), lactose (560 g), citric acid (135 g), potassium citrate (100 g), caramel (25 g), glycerol (68 g) and nicotine (35 g) were stirred with water (1070 ml) at 60° C. until dissolution was complete. Calcium carbonate (60 g) was added and lengths of the vanillin-treated Dexter G10 web were drawn through the mixture as in Example 1. The light brown smoking material was dried, cut, shredded and stored as before. The approximate proportions of components in this material at 9.7% moisture are shown in Table 3.

TABLE 3

| | % |
|---|---|
| cellulose web | 20.0 |
| glucose | 13.2 |
| lactose | 33.6 |
| glycerol | 4.1 |
| caramel | 1.5 |
| citric acid | 8.1 |
| potassium citrate | 6.0 |
| calcium ion | 1.4 |
| vanillin | 0.3 |
| nicotine | 2.1 |
| water | 9.7 |

King-size cigarettes were made from the shredded material and from a 1:1 mixture of this with a standard blend of flue-cured tobacco rag. Both types of cigarette burned well with good smoulder, puffing and ashing properties and with good sidestream smoke aroma.

EXAMPLE 3

Glucose (220 g), lactose (560 g), citric acid (135 g), potassium citrate (108 g), glycerol (80 g), caramel (30 g) and nicotine (35 g) were stirred with water (1100 ml) at 60° C. until dissolution was complete. The solution was cooled to 30° C. and calcium acetate (18 g) was added followed by calcium carbonate (60 g) as in Example 1. Lengths of vanillin-treated Dexter G10 web were drawn through the mixture and processed as before. The shredded material was sprayed with a solution of palmitic acid (2 g), tripalmitin (2 g), methyl palmitate (2 g), $\beta$-carotene (0.2 g), $\alpha$-tocopherol (2 g) in a 1:1 mixture (600 ml) of ethyl acetate and n-hexane to give a 1% loading of the lipid mixture following evaporation of the solvents. The approximate composition of the yellow/brown product at 10.8% moisture is shown in Table 4.

TABLE 4

| | % |
|---|---|
| cellulose web | 13.0 |
| glucose | 13.7 |
| lactose | 34.9 |
| glycerol | 5.0 |
| caramel | 1.9 |
| citric acid | 8.4 |
| potassium citrate | 6.7 |
| calcium ion (ex calcium carbonate) | 1.5 |
| calcium acetate | 0.6 |
| vanillin | 0.3 |
| nicotine | 2.2 |
| lipids | 1.0 |
| water | 10.8 |

Following a 2 week curing period, king-size cigarettes were made from this smoking material alone and from a blend with flue-cured tobacco. Smoking properties were good. Acetic acid, liberated from the added calcium acetate, was pleasantly noticeable in the mainstream smoke aftertaste.

EXAMPLE 4

Glucose (220 g), lactose (560 g), citric acid (135 g), potassium citrate (100 g), glycerol (80 g), caramel (30 g), spray-dried licorice (20 g) and nicotine (35 g) were stirred with water (1070 ml) at 60° C. until dissolution was complete. Calcium carbonate (60 g) was added and lengths of Dexter G10 web were drawn through the mixture as in Example 1.

The smoking material was dried rapidly to approximately 5% moisture, shredded and the bulked material was conditioned at 28% relative humidity for one week. Curing was completed by storing at ambient relative humidity for 2 further weeks. The approximate composition of the golden brown product at 9.8% moisture is shown in Table 5.

TABLE 5

| | % |
|---|---|
| cellulose web | 15.0 |
| glucose | 13.6 |
| lactose | 34.7 |
| glycerol | 5.0 |
| caramel | 1.9 |
| citric acid | 8.4 |
| potassium citrate | 6.2 |
| calcium ion | 2.0 |
| licorice | 1.2 |
| nicotine | 2.2 |
| water | 9.8 |

King-size cigarettes, made from this smoking material alone and from the material blended 1:1 with tobacco, burned well with good smoulder, puffing and ashing properties.

EXAMPLE 5

Glucose (200 g), lactose (580 g) and calcium hydroxide powder (90 g) were intimately mixed and added with stirring to a solution of glycerol (80 g) and caramel (40 g) in water (1000 ml) giving a brown solution of pH 12.

Citric acid (213 g), potassium citrate (100 g) and nicotine (35 g) were stirred with water (200 ml) giving a solution in which spray-dried licorice (20 g) was dissolved.

The above two solutions were mixed giving a solution of pH 4 containing approximately 53% solids. Lengths of Dexter G10 web were drawn through the mixture immediately following the onset of calcium citrate precipitation which occurred approximately 30 minutes after mixing. Calcium citrate precipitation did not reach an advanced stage until after web coating had been completed some 20 minutes later. Drying, shredding and curing were conducted as in Example 4.

The approximate composition of the golden brown product at 10% moisture is shown in Table 6.

TABLE 6

| | % |
|---|---|
| cellulose web | 14.9 |
| glucose | 11.4 |
| lactose | 33.1 |
| glycerol | 4.6 |
| caramel | 2.3 |
| citric acid | 12.1 |
| potassium citrate | 5.7 |
| calcium ion | 2.8 |
| licorice | 1.1 |

TABLE 6-continued

| | % |
|---|---|
| nicotine | 2.0 |
| water | 10.0 |

Filling value was 3 cc. per gram at 61% relative humidity.

King-size cigarettes, made from this smoking material alone and from the material blended 1:1 with tobacco, burned well with good smoulder, puffing and ashing properties.

EXAMPLE 6

Dexter G10 web was drawn through a 3.0% ethanolic solution of the flavouring composition shown in Table 7.

TABLE 7

| | Parts |
|---|---|
| cinnamon oil | 10 |
| menthol | 20 |
| vanillin | 150 |
| β-damascone | 20 |
| coumarin | 15 |
| "Ambroxan" (Trade Mark) | 3 |
| limonene | 100 |

Residual ethanol was evaporated.

Glucose (850 g), powdered calcium hydroxide (20 g) and potassium hydroxide (18 g) were intimately mixed and added with stirring to a solution of glycerol (35 g) and caramel (50 g) in water (900 ml).

Citric acid (150 g) and nicotine (40 g) were stirred with water (120 ml) giving a solution in which spray-dried licorice (50 g) was dissolved.

The two solutions were combined, the above flavoured web was drawn through the mixture and the coated web was dried, shredded and stored at 28% relative humidity for 4 weeks after which time semi-crystrallisation had occurred. The shreds were then immersed in a lipid solution described in Example 3 and, following evaporation of the solvent, they were cured for a further 2 week period. The yellow/brown product contained approximately 17% cellulose, 58% glucose, 2.7% nicotine and 2.4% glycerol.

King/size cigarettes made from this material burned well with good smoulder, puffing and ashing properties. Maintream smoke was mild and pleasant with sweet, menthol character. Sidestream smoke exhibited pleasant sweet, oriental, woody notes. Aftertaste was sweet and mentholic with slight powdery mouth-feel.

EXAMPLE 7

Cured shredded smoking material of Example 4 was immersed in a flavoured lipid solution. The lipid solution was as described in Example 3 and to this was added a concentrated ethanolic solution of the flavouring composition shown in Table 8.

TABLE 8

| | Parts |
|---|---|
| blackberry flavour (Polaks Frutal Works 47) | 200 |
| damascenone | 50 |
| β-damascone | 50 |
| 6-methyl-3,5-heptadiene-2-one | 20 |
| isophorone | 20 |
| "Ambroxan" (Trade Mark) | 1 |
| cinnamon oil | 1 |
| artificial brandy(M. F. Neal No. F02035) | 20 |

TABLE 8-continued

| | Parts |
|---|---|
| trimethylpyrazine | 10 |
| vanillin | 100 |

Concentrations were calculated so that, following removal of excess lipid/flavour solution and evaporation of residual solvent, the loading of the mixed lipids on the shredded material was approximately 1.0% and that of the total flavour composition was 0.01%. The finished smoking material (60 parts) was mixed with a commercial hand-rolling tobacco blend (40 parts). "Roll-your-own" cigarettes, prepared from the mixture, were preferred to 100% tobacco controls.

King-size cigarettes, made solely from the smoking material, were particularly characterised by pleasant, sweet, powdery aftertaste and sweet, fruity sidestream smoke aroma.

EXAMPLE 8

The procedure of Example 3 was repeated except that the Dexter G10 web was replaced by Crompton 780 web supplied by J. F. Crompton PLC of Elton Paper Mill, Bury, Lancashire, England, BL8 2AS. Cigarettes made from the cured shredded smoking material were indistinguishable from those made according to Example 3.

EXAMPLE 9

Glucose (2.4 kg), lactose (5.6 kg), citric acid (1.35 kg), potassium citrate (1.0 kg) and nicotine (0.35 kg) were dissolved in water (15 L.) and the solution was pumped to a spray-drier at a rate of 3.3 kg/hr. The inlet temperature was set at 170° C. and the outlet temperature was 82°-90° C. The resulting spray-dried powder contained 3% nicotine (measured by a standard gas chromatographic method) at 10% moisture.

Trimethylsilyl derivatives were prepared from small aliquots of the powder and analysed by gas chromatography. The chromatograms indicated that some rearrangement of the $\alpha$- and $\beta$- forms of the sugar pyranoids and furanoids had occurred but no anhydrosugars were detected and little difference was found in the crystallisability of this mixture compared with that of the mixture prior to spray drying.

The spray-dried powder was dissolved in minimal water along with glycerol, caramel and spray-dried licorice. Following addition of a calcium carbonate aliquot, the mixture was used to coat Dexter G10 and Crompton 740 cellulosic webs as in previous Examples.

EXAMPLE 10

A smoking material was prepared as in Example 2 except that the glucose was totally replaced by lactose (760 g) and extra glycerol (72 g) was added. The material cured well in spite of a relatively high glycerol content (8.1% at 10.0% moisture).

King-size cigarettes made from the shredded material burned well with good smoulder, puffing and ashing properties, but with more than usual staining of the cigarette paper.

EXAMPLE 11

The procedure of Example 4 was repeated using an assembly of cotton threads in place of the cellulosic web. The dried coated threads were cured in bulk for 2 weeks, coated by immersion with a lipid mixture described in Example 3 and then cut to random lengths of about 1-2.5 cm.

Cigarettes hand-rolled from the finished smoking material burned well with good smoulder, puffing and ashing properties.

EXAMPLE 12

The procedure of Example 5 was repeated except that half of the caramel in the first solution and all of the nicotine in the second were replaced by a supercritical carbon dioxide extract (60 g) of rustica tobacco added to the second solution.

The finished smoking material resembled that of Example 5 in appearance and smoking properties. Nicotine content, determined by a gas chromatographic method, was 1.7%.

EXAMPLE 13

Smoking material was made according to the method of Example 1 except that no nicotine was added. The shredded finished smoking material (20 parts) was blended with high nicotine flue-cured tobacco (40 parts) and burley tobacco (40 parts) at 30% moisture and at a temperature of 40° C. for 1 hour. The resulting blend (average nicotine 2.1%) was held at 61% relative himidity for 8 weeks.

Cigarettes prepared from this blend had good burning and pleasant subjective properties.

Shreds of trhe colourless smoking material, separated from the blend, were found to contain 0.6% nicotine, presumably on account of migration from tobacco shreds during blending and storage.

EXAMPLE 14

Lactose (740 g), citric acid (135 g), potassium citrate (100 g), caramel (25 g), glycerol (250 g) and nicotine (42 g) were stirred with water (950 ml) at 60° C. until dissolution was complete. Calcium carbonate (60 g) was added and lengths of Dexter G10 web were drawn through the mixture as in Example 1. The coated web was dried, shredded and cured for 2 weeks.

The approximate composition of the light brown product at 9.7% moisture is shown in Table 9.

TABLE 9

| | % |
|---|---|
| cellulose web | 10.3 |
| lactose | 45.0 |
| glycerol | 15.2 |
| caramel | 1.5 |
| citric acid | 8.2 |
| potassium citrate | 6.1 |
| calcium ion | 1.5 |
| nicotine | 2.5 |
| water | 9.7 |

King-size cigarettes made from the cured smoking material burned slowly but with heavy staining of the cigarette paper during smoking

EXAMPLE 15

Papirossi-style cigarettes were hand-made in which 40 mm. long, 6 mm. diameter rods of the smoking material of Example 10 (approximately 300 mg) wrapped in low porosity, low opacity paper were attached to 20 mm. long, 6 mm. diameter paper filters which, in turn, were attached by recessing into 30 mm. long stiff paper tubes of 8 mm. external diameter.

The cigarettes were variable but some give per cigarette yields of approximately 1 mg nicotine and 12 mg particulate material (water and nicotine free) using the standard smoking regime. Visible sidestream smoke was low and significant paper staining was not apparent. In excess of one third by weight of the particulate material generated from these cigarettes was glycerol.

Similar cigarettes made from the smoking material of Example 10, in which nicotine concentration was increased from 2.1% to 3.5% exhibited a tar to nicotine ratio of approximately 8.

The appearance of cigarettes made with low opacity cigarette paper was improved by reducing the colour density of the smoking material.

EXAMPLE 16

Example 5 was repeated except that the Dexter G10 web was replaced by a commercially available cellulosic web having a weight per unit area of 19 g/m$^2$ and an embossed simple oval pattern (2 mm.×1 mm. with 0.5–1 mm. relief repeated at 4 mm. minimum and 7 mm. maximum intervals). Filling value of the finished smoking material was 3.8 cc. per gram at 61% relative humidity.

In the claims:

1. A smoking material consisting of an open-structured substrate of cellulosic material having a crystallizable or semi-crystallizable coating including at least one sugar, the proportion of the coating to the weight of the smoking material being in the range of 50–95%.

2. A smoking material as claimed in claim 1 wherein the proportion of the at least one sugar to the weight of the coating is in the range 20–90%.

3. A smoking material as claimed in claim 1 wherein the proportion of the at least one sugar to the weight of the finished material is in the range 20–80%.

4. A smoking material as claimed in claim 1 wherein the substrate is a fibrous web or fleece prepared from natural, regenerated, synthetic or chemically modified carbohydrate material and having a weight in the range 5–150 g/m$^2$ and a thickness in the range 5–150 microns.

5. A smoking material as claimed in claim 1 wherein the substrate comprises discrete cotton threads or assemblies thereof.

6. A smoking material as claimed in claim 1 wherein the substrate is a paper-like sheet prepared from cellulosic pulp material by a conventional paper-making process.

7. A smoking material as claimed in claim 6 wherein the sheet has a weight in the range 10–30 g/m$^2$ and a thickness in the range 10–30 microns.

8. A smoking material as claimed in claim 7 wherein the sheet is a porous web wet-strengthened with regenerated cellulose.

9. A smoking material as claimed in claim 7 wherein the sheet has a porosity in the range 50–1000 K.

10. A smoking material as claimed in claim 1 wherein said at least one sugar is selected from the group consisting of glucose, galactose, xylose, lactose, sucrose and fructose.

11. A smoking material as claimed in claim 10 wherein the sugar component is either lactose or glucose or a mixture of glucose and lactose in which the proportion of glucose is in the range 20–40% by weight.

12. A smoking material as claimed in claim 1 including a polyhydric humectant or plasticiser.

13. A smoking material as claimed in claim 12 wherein the polyhydric humectant or plasticiser is selected from the group consisting of glycerol, glycerol monoesters, propylene glycol, and sorbitol.

14. A smoking material as claimed in claim 13 wherein the concentration of the polyhydric humectant or plasticiser in the finished material is in the range 4–30% by weight.

15. A smoking material as claimed in claim 1 including lipoidal or lipophilic compounds.

16. A smoking material as claimed in claim 5 wherein the lipoidal or lipophilic compounds are selected from the group consisting of fatty alcohols, fatty acids, fatty esters, glycerides and natural lipid mixtures.

17. A smoking material as claimed in claim 16 wherein the lipoidal or lipophilic compounds are selected from the group consisting of palmitic acid, dodecanol, methyl palmitate, dipalmitin, tripalmitin, α-tocopherol, triolein, and natural lipid oils.

18. A smoking material as claimed in claim 1 including ash improvement agents and burn control agents.

19. A smoking material as claimed in claim 18 wherein the ash and burn control agents are selected from the group consisting of calcium and potassium salts of polycarboxylic and hydroxy acids.

20. A smoking material as claimed in claim 1, including at least one acidifying agent.

21. A smoking material as claimed in claim 20 wherein the acidifying agent is a polycarboxylic acid or a hydroxy acid.

22. A smoking material as claimed in claim 21 wherein the polycarboxylic and hydroxy acids are selected from the group consisting of oxalic, tartaric, citric, malic and lactic acids.

23. A smoking material as claimed in claim 1 containing added nicotine, a nicotine derivative, or a nicotine-rich tobacco extract.

24. A smoking material as claimed in claim 23 wherein the proportion of the nicotine is in the range 0.5–10% by weight.

25. A process for making a smoking material comprising treating an open-structured cellulosic web with a crystallizable or semi-crystallizable preparation containing at least one sugar, drying the treated web, and subsequently storing the dried treated web until a spontaneous curing process which involves crystallization or semi-crystallization is substantially complete, the proportion of the treating material to the weight of the smoking material after curing being in the range of 50–95%.

26. A process as claimed in claim 25 wherein the web is treated with burn control agents prior to treatment with the crystallizable or semi-crystallizable preparation.

27. A process as claimed in claim 25 wherein the treated web is further treated with lipoidal or lipophilic compounds after it has been dried.

28. A process as claimed in claim 25 wherein nicotine in said crystallizable or semi-crystallizable preparation is either nicotine, a nicotine derivative, or a nicotine-rich tobacco extract.

29. A process as claimed in claim 25 including the following steps for preparing said crystallizable or semi-crystallizable preparation prior to treatment of the web, (a) preparing an aqueous solution including at least one sugar, at least one polycarboxylic or hydroxy acid, and a polyhydric humectant, (b) adding calcium carbonate and/or calcium acetate to said aqueous solution.

30. A process as claimed in claim 25 including the following steps for preparing said crystallizable or semi-crystallizable preparation prior to treatment of the web:

(a) preparing a first aqueous solution including at least one sugar and calcium hydroxide;

(b) preparing a second aqueous solution including citric acid; and, (c) mixing the first and second solutions and waiting until the onset of calcium citrate precipitation so as to provide the crystallizable or semi-crystallizable preparation.

31. A process as claimed in claim 25 including the following steps for preparing said crystallizable or semi-crystallizable preparation prior to treatment of the web:

(a) preparing an aqueous solution including at least one sugar, nicotine and citric acid;

(b) spray-drying said solution to a powder;

(c) dissolving the spray-dried powder in a minimal amount of water; and (d) adding calcium carbonate and/or calcium acetate to the solution.

32. A process as claimed in claim 25 wherein the curing step includes conditioning at a relative humidity of 28% for 1 week, followed by storage at ambient relative humidity for 2 weeks.

33. A process as claimed in claim 25 wherein the dried web is cut and shredded between drying and storing.

34. A smoking material as claimed in claim 1 including natural, nature-identical or synthetic flavouring materials.

35. A smoking material as claimed in claim 1 including natural, nature-identical, or synthetic colouring agents.

36. A smoking material as claimed in claim 35 wherein the colouring agents are selected from caramel and $\beta$-carotene.

* * * * *